US009151129B2

(12) United States Patent
Jolicoeur et al.

(10) Patent No.: US 9,151,129 B2
(45) Date of Patent: Oct. 6, 2015

(54) CORE BARREL ASSEMBLY INCLUDING A VALVE

(75) Inventors: Martin Jolicoeur, Lachine (CA); Jacques Carriere, Preissac (CA)

(73) Assignee: GROUPE FORDIA INC., Dollard-des-Ormaux (CA)

( * ) Notice: Subject to any disclaimer, the term of this patent is extended or adjusted under 35 U.S.C. 154(b) by 453 days.

(21) Appl. No.: 13/564,231

(22) Filed: Aug. 1, 2012

(65) Prior Publication Data

US 2013/0032410 A1 Feb. 7, 2013

Related U.S. Application Data

(60) Provisional application No. 61/573,001, filed on Aug. 1, 2011.

(51) Int. Cl.
*E21B 25/02* (2006.01)

(52) U.S. Cl.
CPC ..... *E21B 25/02* (2013.01)

(58) Field of Classification Search
CPC ..... E21B 23/02; E21B 25/02
USPC ..... 175/244, 245, 246, 247, 249, 250; 403/321, 322.1
See application file for complete search history.

(56) References Cited

U.S. PATENT DOCUMENTS 1,716,092 A 6/1929 Smith
1,828,775 A 10/1931 Humason
1,830,012 A 11/1931 Barrett
1,830,381 A 11/1931 Babbett
1,830,685 A 11/1931 Wellensiek
1,900,618 A 3/1933 Robichaux
1,948,632 A 2/1934 Barrett et al.
2,018,414 A 10/1935 Oksenholt
2,019,176 A 10/1935 Dodds et al.
2,064,255 A * 12/1936 Garfield ..... 175/257
2,073,263 A 3/1937 Hohmann et al.
2,079,941 A 5/1937 Labarre
2,108,949 A 2/1938 Snyder
2,138,006 A 11/1938 Howard et al.
2,141,800 A 12/1938 Smetherman
2,141,840 A 12/1938 Howard
2,145,170 A 1/1939 Frenzel et al.
2,153,812 A 4/1939 Newton
2,153,815 A 4/1939 Snyder et al.
2,164,598 A 7/1939 Thrift
2,167,991 A 8/1939 Oliver et al.
2,184,343 A 12/1939 Harrington
2,189,057 A 2/1940 Copelin et al.
2,189,923 A 2/1940 Phipps et al.

(Continued)

*Primary Examiner* — Robert E Fuller
*Assistant Examiner* — David Carroll

(57) ABSTRACT

A core barrel assembly for retrieving a core sample. The core barrel assembly includes a retrieving element defining an inner tube for retrieving the core sample thereinto, a locking assembly including latch dogs for locking the core retrieving assembly inside the outer tube and a valve assembly mechanically coupled to the locking assembly and provided proximally relative thereto for controlling the flow of fluid across the core barrel assembly. The core barrel assembly is operable in a retrieving configuration in which the latch dogs are retracted and the valve assembly is closed, in a locking configuration in which a locking element locks the latch dogs in an extended configuration and the valve assembly is open and a retrieving configuration, in which the latch dogs are force in a retracted configuration and the valve assembly is open.

20 Claims, 6 Drawing Sheets

(56) References Cited

U.S. PATENT DOCUMENTS

| | | | | | |
|---|---|---|---|---|---|
| 2,197,222 | A | | 4/1940 | Norman | |
| 2,217,203 | A | | 10/1940 | Hill et al. | |
| 2,220,554 | A | | 11/1940 | Straatman | |
| 2,230,568 | A | | 2/1941 | Howard | |
| 2,234,264 | A | | 3/1941 | Lang et al. | |
| 2,248,910 | A | | 7/1941 | Weber et al. | |
| 2,258,352 | A | | 10/1941 | Catland et al. | |
| 2,314,352 | A | | 10/1941 | Catland et al. | |
| 2,300,823 | A | * | 11/1942 | Whitman | 175/25 |
| 2,330,157 | A | | 9/1943 | Stokes et al. | |
| 2,331,553 | A | | 10/1943 | Stokes et al. | |
| 2,374,961 | A | | 5/1945 | Sewell | |
| 2,428,139 | A | * | 9/1947 | Bridwell et al. | 166/133 |
| 2,494,363 | A | | 1/1950 | Sewell | |
| 2,760,758 | A | | 8/1956 | Taylor et al. | |
| 2,829,868 | A | * | 4/1958 | Pickard et al. | 175/246 |
| 2,885,007 | A | | 5/1959 | Hoffer | |
| 2,948,339 | A | * | 8/1960 | Fredd | 166/215 |
| 2,960,165 | A | | 11/1960 | Schramm | |
| 3,103,981 | A | | 9/1963 | Harper | |
| 3,120,282 | A | | 2/1964 | Pickard et al. | |
| 3,120,283 | A | | 2/1964 | Braun et al. | |
| 3,127,943 | A | | 4/1964 | Mori | |
| 3,150,727 | A | * | 9/1964 | Garrison | 175/78 |
| 3,225,845 | A | * | 12/1965 | Koontz et al. | 175/236 |
| 3,266,835 | A | | 8/1966 | Hall et al. | |
| 3,292,717 | A | | 12/1966 | Hall et al. | |
| 3,305,033 | A | * | 2/1967 | Pickard et al. | 175/246 |
| 3,333,647 | A | | 8/1967 | Karich et al. | |
| 3,340,939 | A | | 9/1967 | Lindelof et al. | |
| 3,461,981 | A | | 8/1969 | Linn et al. | |
| 3,481,412 | A | | 12/1969 | Rowley | |
| 3,485,310 | A | | 12/1969 | Milosevich et al. | |
| 3,627,067 | A | * | 12/1971 | Martinsen | 175/58 |
| 3,667,558 | A | | 6/1972 | Lambot et al. | |
| 3,704,755 | A | | 12/1972 | Wolda et al. | |
| 3,704,756 | A | | 12/1972 | Wolda | |
| 3,724,568 | A | | 4/1973 | Koepke | |
| 3,741,323 | A | | 6/1973 | Constantinescu et al. | |
| 3,756,331 | A | | 9/1973 | Okuyama et al. | |
| 3,777,826 | A | | 12/1973 | Wolda et al. | |
| 3,874,466 | A | | 4/1975 | Fulford et al. | |
| 3,951,219 | A | | 4/1976 | Cortes | |
| 3,955,633 | A | | 5/1976 | Bowles | |
| 4,418,770 | A | * | 12/1983 | Lambot | 175/58 |
| 4,452,321 | A | | 6/1984 | Eriksson | |
| 4,466,497 | A | | 8/1984 | Soinski et al. | |
| 4,773,489 | A | | 9/1988 | Makohl | |
| 4,800,969 | A | | 1/1989 | Thompson | |
| 4,832,138 | A | | 5/1989 | Hallez | |
| 4,834,198 | A | | 5/1989 | Thompson | |
| 4,955,438 | A | | 9/1990 | Juergens et al. | |
| 5,020,612 | A | | 6/1991 | Williams | |
| 5,267,620 | A | * | 12/1993 | Lee | 175/230 |
| 5,325,930 | A | | 7/1994 | Harrison | |
| 5,339,915 | A | | 8/1994 | Laporte et al. | |
| 5,351,765 | A | | 10/1994 | Ormsby | |
| 5,592,994 | A | | 1/1997 | Laporte et al. | |
| 5,601,152 | A | | 2/1997 | Harrison | |
| 5,799,742 | A | | 9/1998 | Soinski et al. | |
| 5,934,393 | A | | 8/1999 | Marshall | |
| 5,992,543 | A | | 11/1999 | Soinski et al. | |
| 6,019,181 | A | | 2/2000 | Soinski et al. | |
| 6,029,758 | A | | 2/2000 | Novacovicci et al. | |
| 6,059,053 | A | * | 5/2000 | McLeod | 175/258 |
| 6,089,335 | A | | 7/2000 | Able | |
| 6,341,656 | B1 | | 1/2002 | Fanuel et al. | |
| 6,425,449 | B1 | * | 7/2002 | Marshall | 175/236 |
| 6,505,693 | B1 | * | 1/2003 | Looijen et al. | 175/249 |
| 6,644,424 | B1 | | 11/2003 | Fanuel | |
| 6,820,703 | B1 | * | 11/2004 | Borg | 175/58 |
| 7,314,101 | B2 | | 1/2008 | Beach | |
| 8,485,280 | B2 | * | 7/2013 | Drenth et al. | 175/58 |
| 2002/0157872 | A1 | | 10/2002 | Attwater | |
| 2008/0246273 | A1 | | 10/2008 | Anderson | |
| 2010/0012383 | A1 | * | 1/2010 | Drenth | 175/246 |
| 2011/0079435 | A1 | | 4/2011 | Drenth et al. | |
| 2011/0083901 | A1 | | 4/2011 | Drenth | |
| 2012/0090894 | A1 | | 4/2012 | Laplante | |

* cited by examiner

CORE BARREL ASSEMBLY INCLUDING A VALVE

The present application claims priority from U.S. Provisional Patent Application Ser. No. 61/573,001 filed on Aug. 1, 2011, the contents of which is hereby incorporated by reference in its entirety.

FIELD OF THE INVENTION

This invention relates to the retrieval of core samples. More particularly, the invention relates to a core barrel assembly including a valve.

BACKGROUND OF THE INVENTION

Core samples are obtained through core drilling operations. Core drilling is typically conducted with a core drill comprising outer and inner tubes, the inner tube being part of a core barrel assembly. A hollow drill bit is attached to the outer tube assembly, so that rotational torque applied to the outer tube assembly is transmitted to the drill bit. A core is generated during the drilling operation, with the core progressively extending along the inner tube assembly as drilling progresses. When a core sample is acquired, the core within the inner tube assembly is fractured. The core barrel assembly, and the fractured core sample contained therein, are then retrieved from within the drill hole, typically by way of a retrieval cable lowered down the drill hole and attached to the core barrel assembly. Once the core barrel assembly has been removed from the bore, the core sample can be removed and subjected to analysis.

Typically, the core barrel assembly is secured in position inside the outer tube by the means of latches that extend substantially radially outwardly from the core barrel assembly. The latches are received inside notches or grooves formed into the inner surface of the outer tube and are selectively retractable for locking and unlocking the core barrel assembly to and from the outer tube. However, currently used latches may become disengaged from the outer tube assembly during the drilling process because of vibrations produced during this process. When drilling upholes, a mislatch represents a danger since the core barrel assembly can come back to the driller's working area. In addition, the core barrel assembly may be damaged if this occurs.

Also, in embodiments in which drilling is performed horizontally or upward, allowing the fluid to reach the end of the bore before the core barrel assembly is positioned nearby could lead to problems as debris could be dislodged and projected with relatively large force through the bore.

Against this background, there exists a need in the industry to provide an improved core barrel assembly.

An object of the present invention is therefore to provide an improved core barrel assembly.

SUMMARY OF THE INVENTION

In a broad aspect, the invention provides a core barrel assembly for retrieving a core sample, the core barrel assembly being insertable in an outer tube part of a drill string and defining an outer tube passageway extending substantially longitudinally therethrough, the outer tube defining a recess extending substantially radially outwardly into the outer tube from the outer tube passageway, the core barrel assembly being usable with a fluid, the core barrel assembly comprising: a core retrieving element defining an inner tube for retrieving the core sample thereinto; a locking assembly for locking the core retrieving assembly inside the outer tube by latching to the recess, the locking assembly being mechanically coupled to the core retrieving element, the locking assembly including a substantially elongated locking assembly body defining a locking assembly body proximal end and a substantially longitudinally opposed locking assembly body distal end; at least two latch dogs each defining a dog proximal section and a dog distal section substantially opposed thereto, the latch dogs being pivotally mounted to the locking assembly body in the dog distal section so as to be movable between a dog retracted configuration and a dog extended configuration, the dog proximal sections being spread apart from each other to a greater extent in the dog extended configuration than in the dog retracted configuration, the latch dogs protruding laterally outwardly from the locking assembly body in the dog extended configuration; a locking element provided laterally inwardly relative to the latch dogs, the locking element being movable substantially longitudinally along the locking assembly body between a locking element proximal position and a locking element distal position, the locking element being movable to the locking element distal position only when the latch dogs are in the dog extended configuration and the locking element allowing movement of the latch dogs to the dog retracted configuration only when the locking element is in the locking element proximal position; and a dog retracting element for selectively moving the latch dogs to the dog retracted configuration; and a valve assembly mechanically coupled to the locking assembly and provided proximally relative thereto, the valve assembly including a valve body defining a valve body proximal end and a substantially longitudinally opposed valve body distal end, the valve body also defining a fluid flow passageway extending longitudinally in the valve body, the valve body also defining an inlet and an outlet both in fluid communication with the fluid flow passageway, the inlet being provided proximally relative to the outlet, the valve body being movable substantially longitudinally relative to the locking assembly body between a valve body proximal position and a valve body distal position, the valve body and the locking assembly body being distanced from each other to a greater extent in the valve body proximal position than in the valve body distal position, the valve body including a seal provided outside of the fluid flow passageway between the inlet and the outlet for preventing flow of the fluid outside of the valve when the core barrel assembly is inserted in the outer tube, the valve assembly also including a valve element movable relative to the valve body between a closing position and an opening position, wherein, in the closing position, the valve element substantially obstructs the fluid flow passageway to prevent a substantial flow of the fluid therethrough, and, in the opening position, the valve element is at least partially retracted from the fluid flow passageway to allow a flow of the fluid therethrough; the core barrel assembly being operable between a lowering configuration, a locked configuration and a retrieving configuration, wherein in the lowering configuration, the latch dogs are in the dog retracted configuration, the locking element is in the locking element proximal position, the valve body is in the valve body distal position and the valve element is in the closing position; in the locked configuration, the latch dogs are in the dog extended configuration, the locking element is in the locking element distal position, the valve body is in the valve body distal position and the valve element is in the opening position; and in the retrieving configuration, the latch dogs are in the dog retracted configuration, the locking element is either in the locking element proximal position or in a position proximal relative to the locking element proximal position, the valve body is in the valve body proximal position and the valve element is in the opening position. In the lowering configuration, the core barrel assembly is movable along the outer tube while preventing flow of the fluid through the fluid flow passageway; in the locked configuration, the core barrel assembly is latchable to the recess with the latch dogs and allows flow of the fluid through the fluid flow passageway, the latch dogs being locked in the dog extended configuration by the locking element; and in the retrieving configuration the core barrel assembly is movable along the outer tube while allowing flow of the fluid through the fluid flow passageway.

In some embodiments of the invention, the valve element is provided substantially adjacent the outlet and is movable substantially longitudinally relative to the valve body between the closing and opening positions, the closing position being proximal relative to the opening position.

In some embodiments of the invention, the locking element and the valve element are operatively coupled to each other so as to be jointly movable relative to the locking assembly body.

In some embodiments of the invention, the dog retracting element includes a sleeve provided outside of the of the locking assembly body, the sleeve being movable substantially longitudinally along the locking assembly body between a sleeve proximal position and a sleeve distal position, wherein, in the sleeve proximal position, at least part of the sleeve is in register with the dog proximal sections so that the latch dogs are forced in the dog retracted configuration, and, in the sleeve distal position, the sleeve is retracted from the dog proximal sections to allow movement of the latch dogs to the dog extended configuration.

In some embodiments of the invention, the sleeve is operatively coupled to the locking element and to the valve element so as to be jointly movable therewith relative to the locking assembly body so that when the locking element is in the locking element proximal and distal positions, the sleeve is respectively in the sleeve proximal and distal positions.

In some embodiments of the invention, the valve body further includes an attachment for attaching a core barrel retrieving element thereto.

In some embodiments of the invention, the core barrel assembly further comprises a locking biasing element operatively coupled to the locking assembly body and to the locking element to bias the locking element towards the locking element distal position.

In some embodiments of the invention, the valve body defines a valve body passageway distal relative to the fluid flow passageway, the valve element being mounted in the valve body passageway; the valve body also defines a valve body aperture extending laterally outwardly from the valve body passageway; and the core barrel assembly includes a sleeve-to-valve element coupling member extending between the sleeve and the valve element, the sleeve-to-valve element coupling member extending through the valve body aperture and being movable longitudinally relative thereto.

In some embodiments of the invention, the locking assembly body defines a locking assembly body passageway proximal to the dog distal sections, the locking element being mounted in the locking assembly body passageway; the locking assembly body also defines a locking assembly body aperture extending laterally outwardly from the locking assembly body passageway; and the core barrel assembly includes a sleeve-to-locking element coupling member extending between the sleeve and the locking element, the sleeve-to-locking element coupling member extending through the locking assembly body aperture and being movable longitudinally relative thereto.

In some embodiments of the invention, the latch dogs are biased towards the dog retracted configuration.

In some embodiments of the invention, the latch dogs are both pivotable about a common dog pivot axis.

In some embodiments of the invention, the latch dogs each define a notch for receiving part of the locking element thereinto.

In another broad aspect, the invention provides a latching assembly usable with a core retrieving element defining an inner tube for retrieving a core sample thereinto, the latching assembly being insertable in an outer tube part of a drill string when secured to the core retrieving element, the outer tube defining an outer tube passageway extending substantially longitudinally therethrough, the outer tube defining a recess extending substantially radially outwardly into the outer tube from the outer tube passageway, the latching assembly being usable with a fluid, the latching assembly comprising the locking assembly and the valve assembly referred to hereinabove.

The proposed core barrel assembly is relatively easily manufacturable at a relatively low cost using known components and methods.

Furthermore, the proposed core barrel assembly is relatively robust and is therefore at relatively low risk of being damaged during operation.

The proposed core barrel assembly is relatively safe to use as it helps in preventing locking in place the core barrel assembly during the drilling operation while preventing the generation of a backpressure by the fluid when the core barrel assembly is lowered in the bore.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
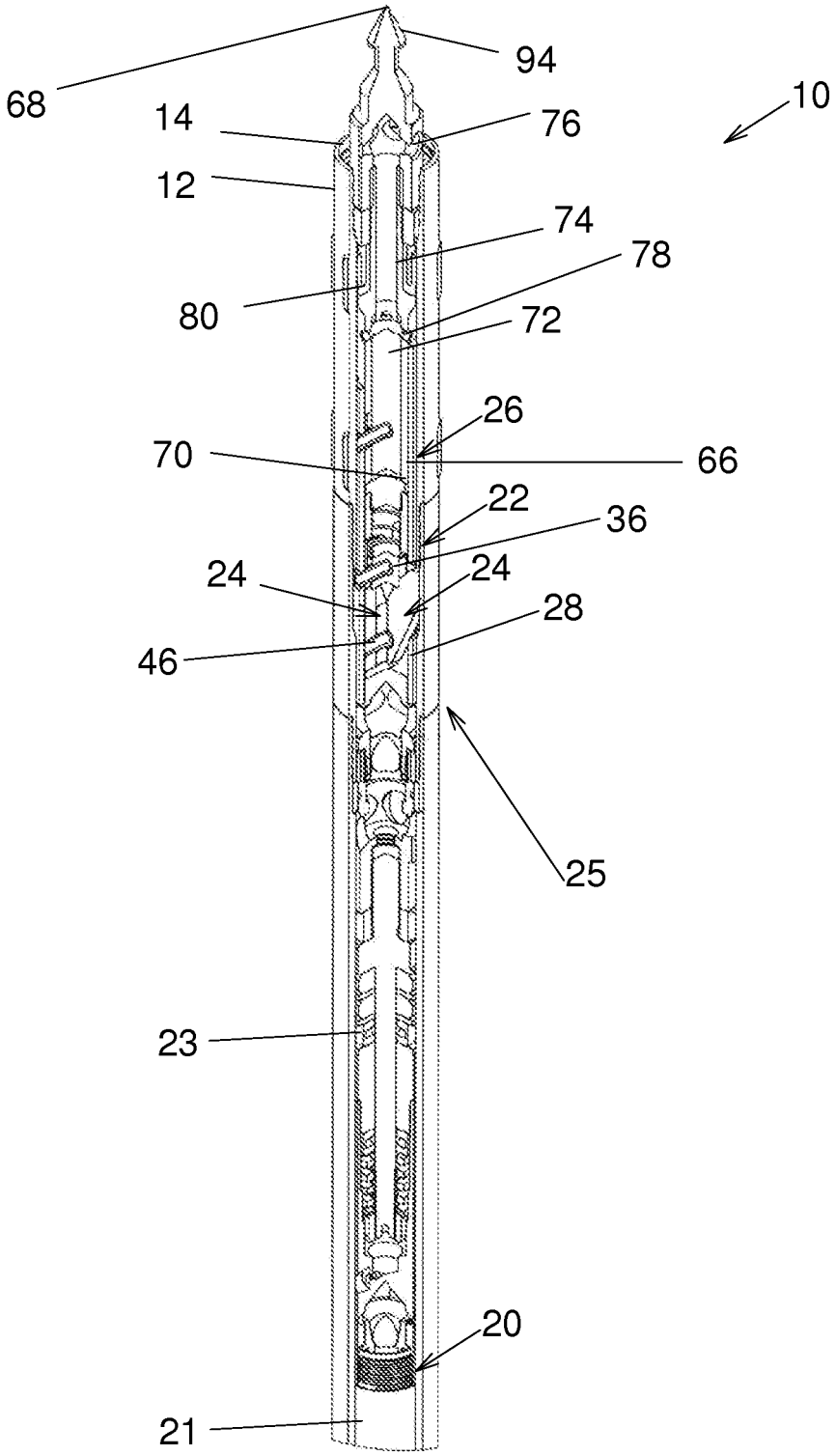
FIG. 1, in a perspective view with parts removed, illustrates a core barrel assembly in accordance with an alternative embodiment of the present invention, the core barrel assembly being shown inserted in an outer tube.

Referring to FIGS. 1 to 9, there is shown a core barrel assembly 10 for retrieving a core sample (not shown in the drawings) in a drilling bore (not shown in the drawings). The drilling bore is drilled using a drill string including an outer tube 12 supporting a distal drill bit (not shown in the drawings). The core sample, drilling bore, outer tube and drill bit are all conventional and are therefore not described in further details herein. As seen for example in FIG. 3, the outer tube 12 defines an outer tube passageway 14 extending substantially longitudinally therethrough and a recess 16 extending substantially radially outwardly into the outer tube 12 from the outer tube passageway 14.

Figure 2:
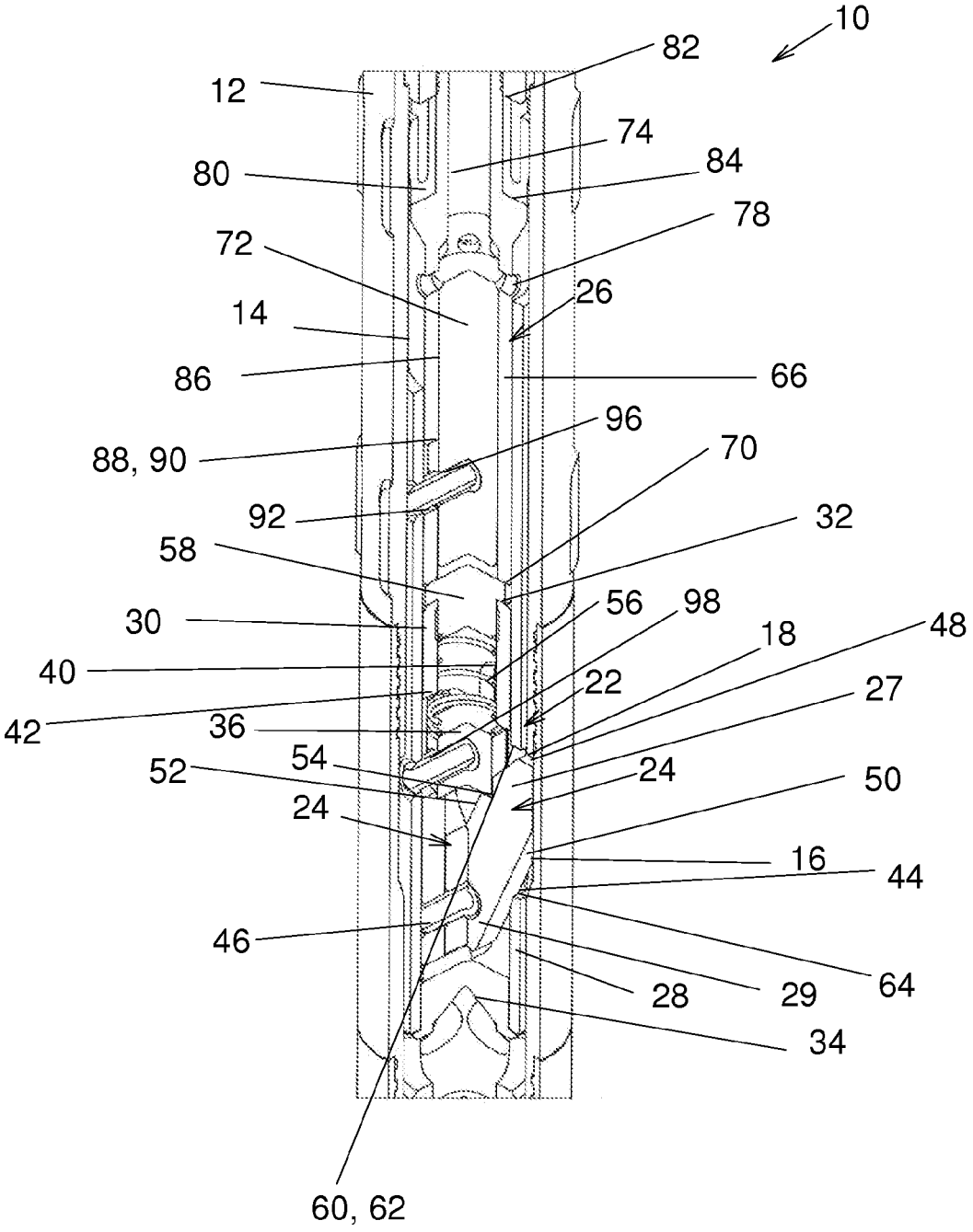
FIG. 2, in a partial perspective view with parts removed, illustrates the core barrel assembly shown in FIG. 1.

In some embodiments of the invention, as better seen in FIG. 2, the recess 16 takes the form of a groove extending substantially circumferentially around the outer tube 12. In other embodiments of the invention, the recess 16 takes the form of a substantially longitudinally extending slot. The recess 16 defines a substantially radially extending ledge 18 located at the proximal end thereof. Typically, the ledge 18 extends substantially perpendicularly to the outer tube passageway 14. In some embodiments of the invention, the outer tube 12 includes many substantially tubular components that are axially attached to each other. In these embodiments, the recess 16 can be formed at the junction of two of these tubular components.

The core barrel assembly 10 is usable with a fluid, represented by arrows 11 in FIGS. 4 to 9. The fluid 11 is a conventional drilling fluid. Referring to FIG. 1, the core barrel assembly 10 includes a core retrieving element 20 defining a conventional inner tube (partially shown in FIG. 1) for retrieving the core sample thereinto, a locking assembly 22 and a valve assembly 26. The locking assembly 22 and the valve assembly 26 together form a latching assembly 25. The valve assembly 26 is typically provided proximally relative to the locking assembly 22. While the latching assembly 25 is usable in combination with the core retrieving element 20 to retrieve a core sample, in alternative embodiments of the invention, the latching assembly 25 is usable, for example and non-limitingly, to lower a surveying instrument in the bore hole. The core barrel assembly 10 typically has a generally cylindrical configuration, so as to conform to the shape of the outer tube 12. However, other configurations are within the scope of the present invention.

The terminology distal and proximal refers to the distance from an operator located outside of the bore. Therefore, proximal elements are closer to the operator of the core barrel assembly 10 than distal elements. Also, the terminology "substantially" is used to denote variations in the thus qualified terms that have no significant effect on the principle of operation of the core barrel assembly 10. These variations may be minor variations in design or variations due to mechanical tolerances in manufacturing and use of the core barrel assembly 10. These variations are to be seen with the eye of the reader skilled in the art.

The locking assembly 22 is provided for locking the core retrieving element 20 inside the outer tube 12 by latching to the recess 16. The locking assembly 22 includes a substantially elongated locking assembly body 30 defining a locking assembly body proximal end 32 and a substantially longitudinally opposed locking assembly body distal end 34, at least two latch dogs 24, a locking element 36 and a dog retracting element 28.

The locking assembly 22 is mechanically coupled to the core retrieving element 20. Typically, the core retrieving element 20 is secured to the locking assembly 22 using a conventional bearing assembly 23 (seen in FIG. 1). The bearing assembly 23 allows for rotation of the core retrieving element 20 with respect to the positioning assembly 20. The core retrieving element 20 and its coupling to the locking assembly 22 are conventional and will therefore not be described in further details.

Figure 3:
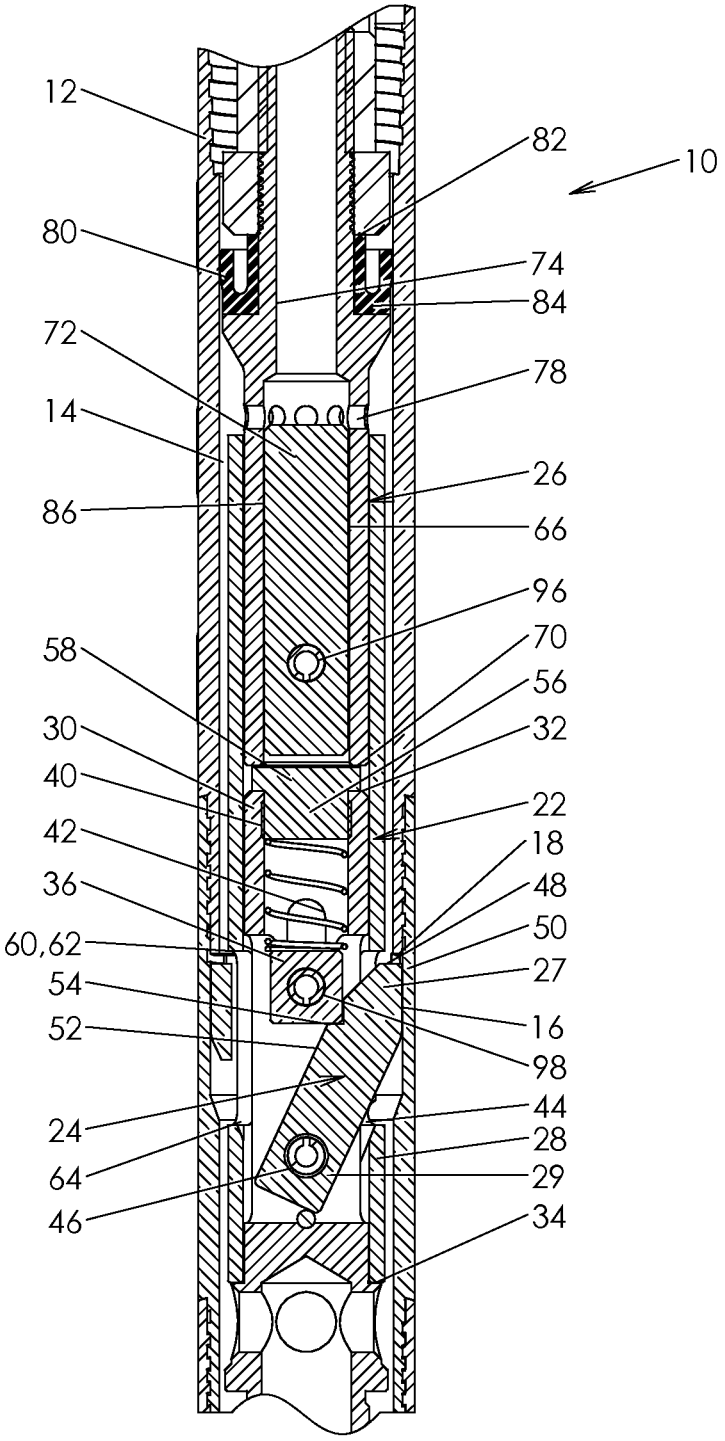
FIG. 3, in a front cross-sectional view with parts removed, illustrates the core barrel assembly shown in FIGS. 1 and 2.

Referring to FIGS. 2 and 3, the locking assembly body 30 defines a locking assembly body passageway 40 extending longitudinally therethrough. The locking assembly body 30 also defines at least one, and typically a pair of diametrically opposed locking assembly body apertures 42 extending laterally outwardly from the locking assembly body passageway 40. For example, the locking assembly body apertures 42 are slit-shaped and extend longitudinally. A pair of latch aperture 44 extend substantially laterally and opposed to each other through the locking assembly body 30 substantially in register with at least part of each latch dog 24 for allowing movements of the latch dogs 24 therethrough.

In the specific embodiment of the invention shown in the drawings, two latch dogs 24 are provided. However, it is within the scope of the invention to provide more than two latch dogs 24. The latch dogs 24 each define a dog proximal section 27 and a dog distal section 29 substantially opposed thereto. The latch dogs 24 are pivotally mounted to the locking assembly body 30 in the dog distal section 29 so as to be movable between a dog retracted configuration (seen in FIGS. 4, 5, 8 and 9 for example) and a dog extended configuration (seen in FIGS. 6 and 7, for example). The dog proximal sections 27 are spread apart from each other to a greater extent in the dog extended configuration than in the dog retracted configuration. The latch dogs 24 protrude laterally outwardly from the locking assembly body 30 in the dog extended configuration. Typically, but not necessarily, the latch dogs 24 are completely retracted in the locking assembly body 30 in the dog retracted configuration.

Typically, the latch dogs 24 are pivotally coupled to a latch pin 46 that extends laterally across the locking assembly body passageway 40 and is fixedly secured to the locking assembly body 30. In some embodiments of the invention, the latch pin 46 is a biased pin that biases the latch dogs 24 towards the dog retracted configuration. However, in alternative embodiments of the invention, the latch dogs 24 are biased toward the dog retracted configuration in any other suitable matter or are not biased towards the dog retracted configuration. The latch dogs 24 pivot in opposite directions as the latch dogs 24 are moved between their respective retracted and extended configurations. The latch dogs 24 are then both pivotable about a common dog pivot axis defined by the latch pin 46.

With reference to FIG. 3, the latch dogs 24 each define a latch dog abutment surface 48 located substantially at the proximal end thereof for abutting against the ledge 18 when the latch dog 24 is in the dog extended configuration. Each latch dog 24 also defines a laterally outwardmost latch dog outer surface 50 and a laterally inwardmost latch dog inner surface 52 located substantially opposed to the latch dog outer surface 50. The latch dog inner surface 52 is angled with respect to the longitudinal axis of the core barrel assembly 10 and extends radially outwardly in a direction leading from the latch pin 46 towards the latch dog abutment surface 48. The latch dog 24 is pivotally attached to the latch pin 46 substantially opposed to the latch dog abutment surface 48. In some embodiments of the invention, the latch dog inner surface 52 defines a notch 54 extending thereinto substantially towards the latch dog outer surface 50 for receiving part of the locking element 36 thereinto.

The locking element 36 is provided laterally inwardly relative to the latch dogs 24. The locking element 36 is provided in a proximal position relative to the latch dogs 24. The locking element 36 is movable substantially longitudinally along the locking assembly body 30 between a locking element proximal position (seen in FIGS. 4, 5, 8 and 9 for example) and a locking element distal position (seen in FIGS. 6 and 7 for example). The locking element 36 is movable to the locking element distal position only when the latch dogs 24 are in the dog extended configuration. The locking element 36 allows movement of the latch dogs 24 to the dog retracted configuration only when the locking element 36 is in the locking element proximal position. In some embodiments of the invention, the locking element 36 is mounted in the locking assembly body passageway 40 and slidable therealong. It should be noted that in some embodiments of the invention, as in the embodiments shown in the drawings, in the locking element proximal position, the locking element 36 is not in the proximalmost position that can be achieved by the locking element 36.

A locking biasing element 56 is operatively coupled to the locking assembly body 30 and to the locking element 36 to bias the locking element 36 towards the locking element distal position. The locking biasing element 56 is provided inside the locking assembly body passageway 40, which is blocked at the proximal end thereof by a plug 58 that is solidly affixed to the locking assembly body 30. Typically, the locking biasing element 56 takes the form of a coil spring that extends between the plug 58 and the locking element 36.

The dog retracting element 28 is provided for selectively moving the latch dogs 24 to the dog retracted configuration. For example, the dog retracting element 28 takes the form of a sleeve 28 provided outside of the of the locking assembly body 30. The sleeve 28 is movable substantially longitudinally along the locking assembly body 30 between a sleeve proximal position (seen in FIGS. 4, 5, 8 and 9 for example) and a sleeve distal position (seen in FIGS. 6 and 7 for example). In the sleeve proximal position, at least part of the sleeve 28 is in register with the dog proximal sections 27 so that the latch dogs 24 are forced in the dog retracted configuration. In the sleeve distal position, the sleeve 28 is retracted from the dog proximal sections 27 to allow movement of the latch dogs 24 to the dog extended configuration.

The sleeve 28 may be entirely retracted from the dog proximal sections 27 in the sleeve proximal position. However, typically, the sleeve 28 extends proximally further than the latch dogs 24. To allow movement of the latch dogs 24 through the sleeve 28 to achieve the dog extended configuration, the sleeve 28 defines a pair of opposed sleeve apertures 60 defining each a sleeve aperture proximal end 62 and a longitudinally opposed sleeve aperture distal end 64. The sleeve apertures 60 are generally slit-shaped and are located such the latch dogs 24 protrude therefrom in the dog extended configuration. In the sleeve proximal position, the latch dogs 24 abut against the sleeve aperture distal end 64, which is positioned such that the latch dogs 24 are thus forced in the dog retracted configuration. Therefore, by "retracted from the dog proximal sections 27", it is meant that no solid portion of the sleeve 28 is in register with the dog proximal sections 27.

As described in further details hereinbelow, the sleeve 28 is operatively coupled to the locking element 36 so as to be jointly movable therewith relative to the locking assembly body 30 so that when the locking element 36 is in the locking element proximal and distal positions, the sleeve 28 is respectively in the sleeve proximal and distal positions.

The valve assembly 26 is mechanically coupled to the locking assembly 22 and provided proximally relative thereto. The valve assembly 26 includes a valve body 66 defining a valve body proximal end 68 (seen for example in FIG. 1) and a substantially longitudinally opposed valve body distal end 70. The valve assembly 26 also includes a valve element 72.

The valve body 66 also defines a fluid flow passageway 74 extending longitudinally in the valve body 66. In addition, the valve body 66 defines an inlet 76 and an outlet 78 both in fluid communication with the fluid flow passageway 74. The inlet 76 is provided proximally relative to the outlet 78. The valve body 66 is movable substantially longitudinally relative to the locking assembly body 30 between a valve body proximal position (seen in FIGS. 8 and 9) and a valve body distal position (seen in FIGS. 3 to 7 for example). The valve body 66 and the locking assembly body 30 are distanced from each other to a greater extent in the valve body proximal position than in the valve body distal position.

The valve body 66 includes a seal 80 provided outside of the fluid flow passageway 74 between the inlet 76 and the outlet 78 for preventing flow of the fluid 11 outside of the valve assembly 26 when the core barrel assembly 10 is inserted in the outer tube 12. The seal 80 is provided so that the fluid 11 must necessarily pass through the fluid flow passageway 74 to reach the distal parts of the core barrel assembly 10 when coming from proximal parts of the core barrel assembly 10.

For example, the seal 80 takes the form of a generally annular element made out of a substantially resiliently deformable material, such as rubber, that has a generally U-shaped radial cross-sectional configuration and that is tight fitted around the outside of the valve body 66 and around the inside of the outer tube 12. In some embodiments of the invention, a distal and a proximal seal ledge 82 and 84, both extending generally radially, are provided by the valve body 66 respectively distally and proximally relative to the seal 80 so that the seal 80 abuts thereagainst and is substantially prevented from moving under the pressure of the fluid 11 thereby.

The valve body 66 includes a valve body passageway 86 distal relative to the fluid flow passageway 74. In some embodiments of the invention, the valve body passageway 86 and the fluid flow passageway 74 extend continuously from each other. The valve body 66 also defines one or more valve body aperture 88 extending laterally outwardly from the valve body passageway 86. For example, the valve body aperture 88 is slit-shaped and longitudinally oriented. In that case, the valve body aperture 88 defines a valve aperture proximal end 90 and a substantially longitudinally opposed valve aperture distal end 92.

The valve body 66 further comprises an attachment 94 for attaching a core barrel retrieving element thereto. The core barrel retrieving element is used to remove the core barrel assembly 10 from the bore hole to retrieve the core sample. For example, the core barrel retrieving element takes the form of a conventional overshot 100, seen partially in FIGS. 8 and 9, able to grasp the attachment 94 that takes the form of conventional pinnacle located at the valve body proximal end 68.

Figures 8, 9:
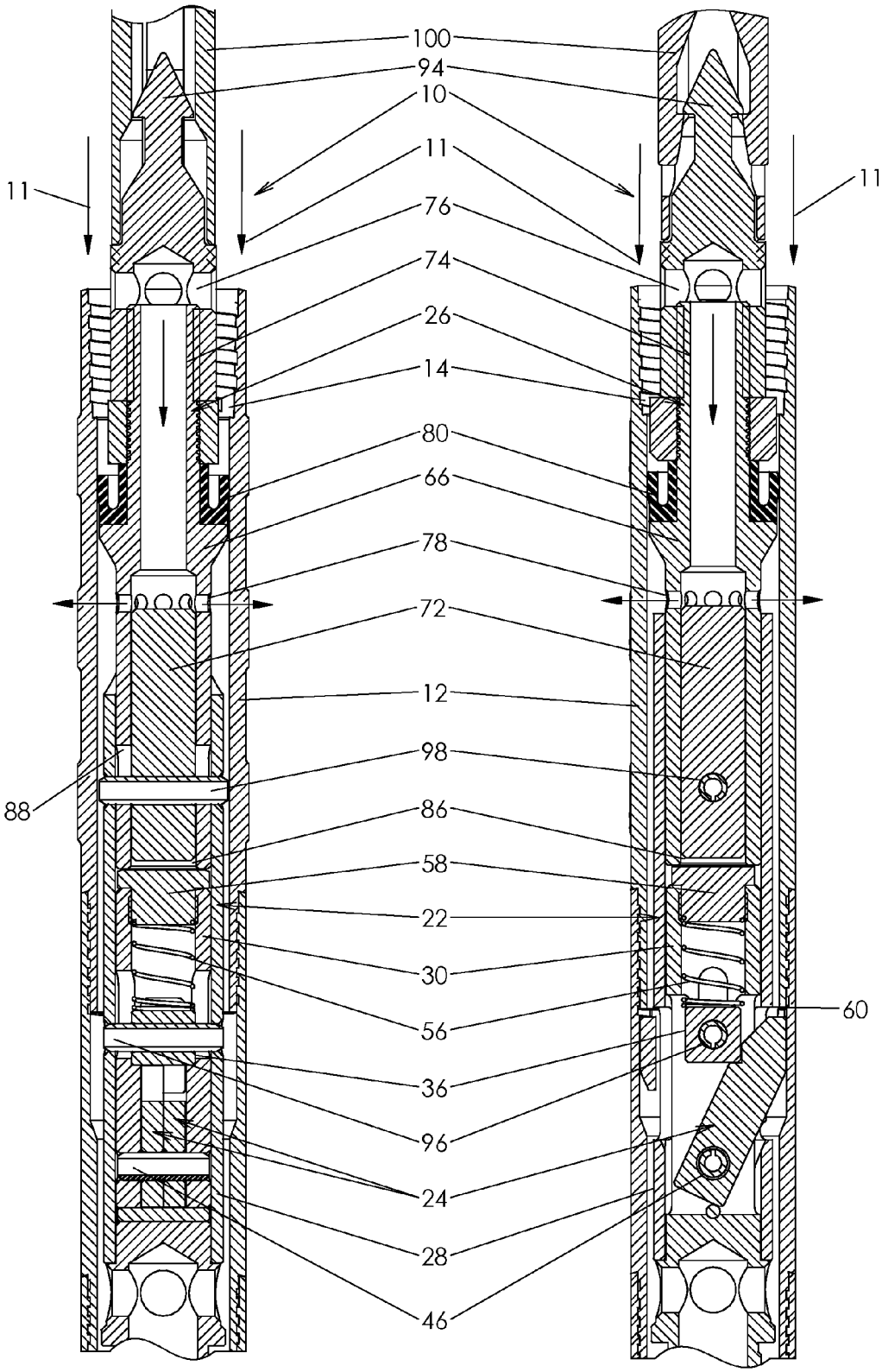
FIG. 8, in a side cross-sectional view with parts removed, illustrates the core barrel assembly shown in FIGS. 1 to 7, the core barrel assembly being shown in a retrieving configuration.
FIG. 9, in a front cross-sectional view with parts removed, illustrates the core barrel assembly shown in FIGS. 1 to 8, the core barrel assembly being shown in the retrieving configuration.

The valve element 72 is movable relative to the valve body 66 between a closing position (seen for example in FIGS. 4 and 5) and an opening position (seen for example in FIGS. 8 and 9). In the closing position, the valve element 72 substantially obstructs the fluid flow passageway 74 to prevent a substantial flow of the fluid 11 therethrough. In the opening position, the valve element 72 is at least partially retracted from the fluid flow passageway 74 to allow a flow of the fluid 11 therethrough. In this paragraph, the term "substantial flow" designates a flow of fluid 11 that is large enough to affect significantly the movements of the core barrel assembly 10 along the outer tube 12. Therefore, in the closing position, the valve element 72 may allow the fluid 11 to leak through the valve assembly 26, but this leak is small enough to prevent a substantial filling of the outer tube 12 that would impede the movements of the core barrel assembly 10 therethrough or that would exert a back pressure tending to push in the proximal direction the core barrel assembly 10. The valve element 72 has a transversal cross-sectional configuration that is substantially similar in shape and dimension to the transversal cross-sectional configuration of the fluid flow passageway 74 adjacent the outlet 98.

The valve element 72 is mounted in the valve body passageway 86. The valve element 72 is provided substantially adjacent the outlet 78 and is movable substantially longitudinally relative to the valve body 66 between the closing and opening positions, the closing position being proximal relative to the opening position. Typically, the inlet 76 is substantially adjacent the attachment 94 and the outlet 78 is substantially adjacent the valve body passageway 86. The fluid flow passageway 74 extends generally longitudinally through the valve body 66 and the inlet 76 and outlet 78 are provided radially outwardly with respect to the fluid flow passageway 74. To that effect, the inlet 76 and outlet 78 take the forms of generally tubular apertures extending radially outwardly from the fluid flow passageway 74. A valve element 72 defining a generally frusto-conical proximal end portion, along with a correspondingly shaped fluid flow passageway 74 adjacent the outlet 78 has been found to provide good fluid flow blocking characteristics, but other shapes are possible.

The locking element 36 and the valve element 72 are operatively coupled to each other so as to be jointly movable relative to the locking assembly body 30. Also, the sleeve 28 is operatively coupled to the valve element 72 so as to be jointly movable therewith relative to the locking assembly body 30. To that effect, in a specific embodiment of the invention, a sleeve-to-valve element coupling member 96 extends between the sleeve 28 and the valve element 72, the sleeve-to-valve element coupling member 96 extending through the valve body aperture 88 and being movable longitudinally relative thereto. Also, a sleeve-to-locking element coupling member 98 extends between the sleeve 28 and the locking element 36. The sleeve-to-locking element coupling member 98 extends through the locking assembly body aperture 42 and is movable longitudinally relative thereto. In some embodiments of the invention, the sleeve-to-valve element coupling member 96 and the sleeve-to-locking element coupling member 98 take the form of pins extending across the sleeve 28. Typically, two or more sleeve-to-valve element coupling members 96 and two or more sleeve-to-locking element coupling members 98 are provided.

The core barrel assembly 10 is operable between a lowering configuration, a locked configuration and a retrieving configuration. In the lowering configuration, the latch dogs 24 are in the dog retracted configuration, the locking element 36 is in the locking element proximal position, the valve body 66 is in the valve body distal position and the valve element 72 is in the closing position. In the locked configuration, the latch dogs 24 are in the dog extended configuration, the locking element 36 is in the locking element distal position, the valve body 66 is in the valve body distal position and the valve element 72 is in the opening position. In the retrieving configuration, the latch dogs 24 are in the dog retracted configuration, the locking element 36 is either in the locking element proximal position or in a position proximal relative to the locking element proximal position, the valve body 66 is in the valve body proximal position and the valve element 72 is in the opening position.

In the lowering configuration, the core barrel assembly 10 is movable along the outer tube 12 while preventing flow of the fluid 11 through the fluid flow passageway 74. In the locked configuration, the core barrel assembly 10 is latchable to the recess 16 with the latch dogs 24 and allows flow of the fluid 11 through the fluid flow passageway 74, the latch dogs 24 being locked in the dog extended configuration by the locking element 36. In the retrieving configuration the core barrel assembly 10 is movable along the outer tube 12 while allowing flow of the fluid 11 through the fluid flow passageway 74.

Figures 4, 5:
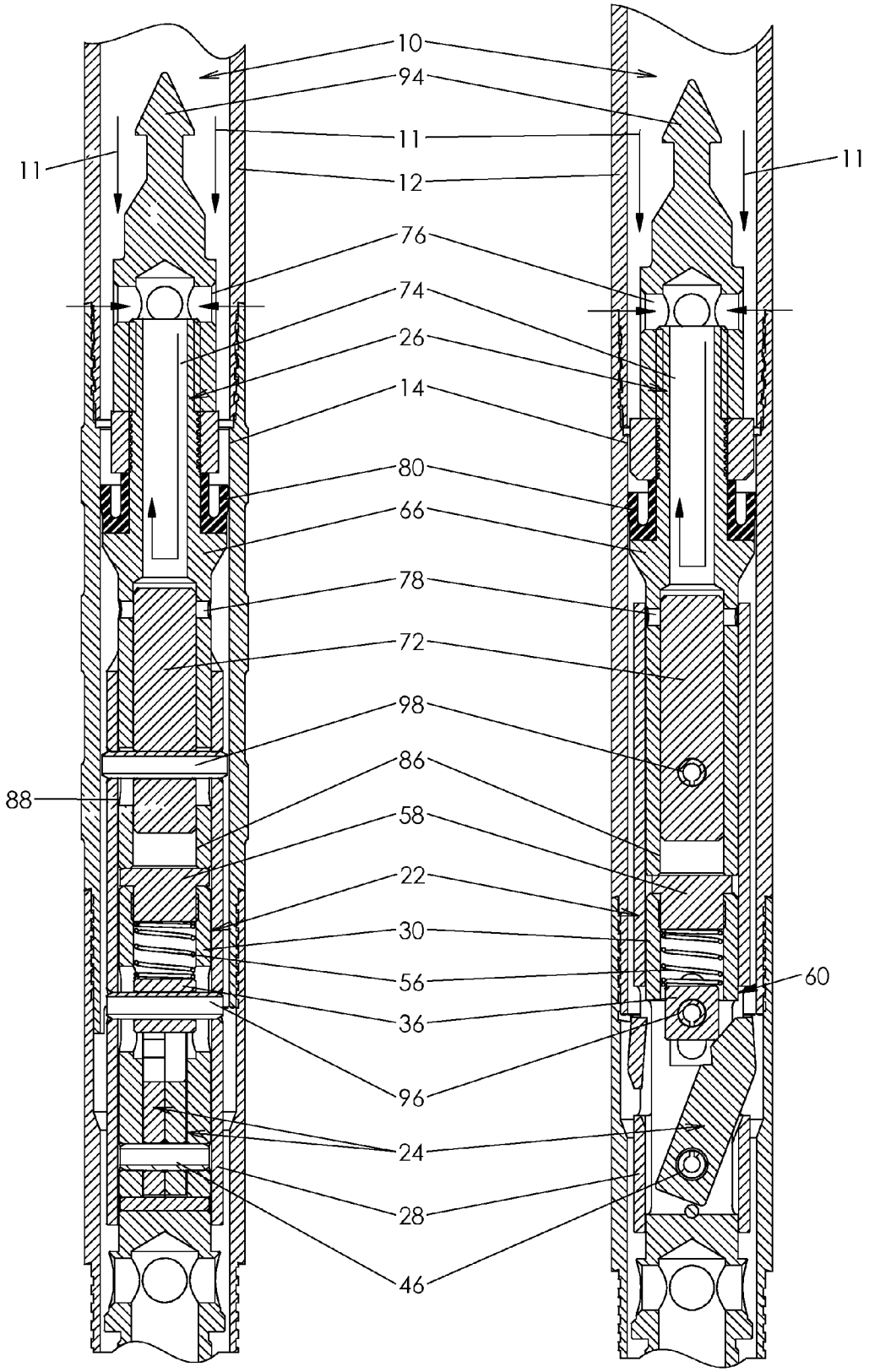
FIG. 4, in a side cross-sectional view with parts removed, illustrates the core barrel assembly shown in FIGS. 1 to 3, the core barrel assembly being shown in a lowering configuration.
FIG. 5, in a front cross-sectional view with parts removed, illustrates the core barrel assembly shown in FIGS. 1 to 4, the core barrel assembly being shown in the lowering configuration.

In a typical use, the core barrel assembly 10 is lowered in the outer tube 12 in the lowering configuration, as seen in FIGS. 4 and 5. The outer tube 12 prevents the latch dogs 24 from reaching the dog extended configuration as its diameter is too small to allow full extension of the latch dogs 24. The fluid 11, which is a conventional drilling fluid, is typically pushed under pressure proximally relative to the core barrel assembly 10, which facilitates movement of the core barrel assembly 10 in the outer tube 12 due to the pressure. In some embodiments, the pressure is large enough to allow pushing the core barrel assembly 10 against gravity. The pressure also helps in maintaining the valve body 66 in the valve body distal position, which, in addition to the rigid link between the valve element 72 and the locking element 36, causes the valve element 72 to remain in the closing position.

Figures 6, 7:
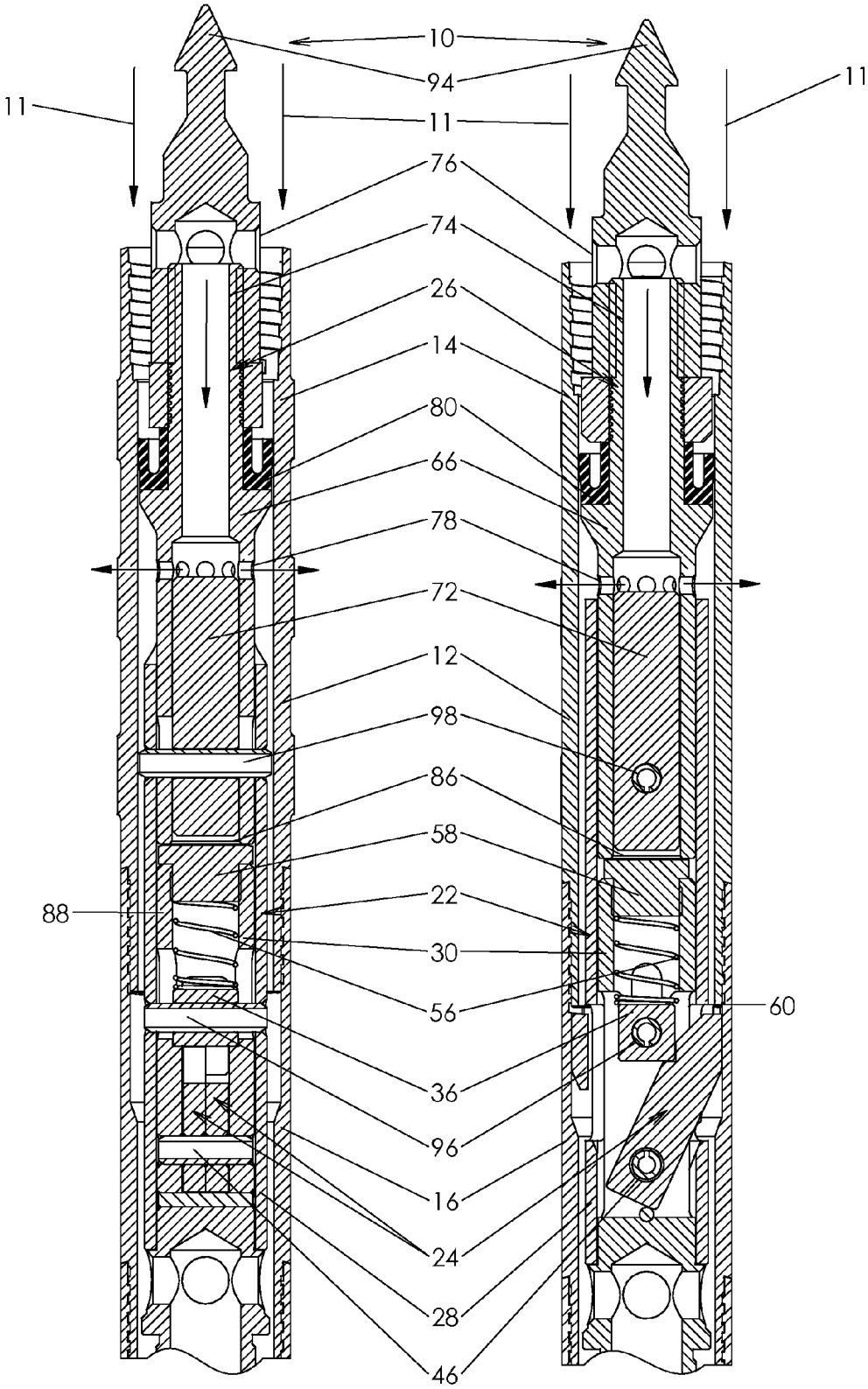
FIG. 6, in a side cross-sectional view with parts removed, illustrates the core barrel assembly shown in FIGS. 1 to 5, the core barrel assembly being shown in a locked configuration.
FIG. 7, in a front cross-sectional view with parts removed, illustrates the core barrel assembly shown in FIGS. 1 to 6, the core barrel assembly being shown in the locked configuration.

Referring to FIGS. 6 and 7, when the recess 16 is reached, the latch dogs 24 are pushed to the dog extended configuration by the locking element 36, which is biased towards the locking element distal position by the locking biasing element 56. The latch dogs 24 thus prevent proximally oriented movements of the core barrel assembly 10 by engaging the recess 56. Simultaneously, the valve element 72 moves to the opening position as the valve element 72 is jointly movable with the locking element 36. This allows flow of the fluid 11 through the fluid flow passageway 74 as fluid pressure maintains the the valve body 66 in the valve body distal position. Drilling can then be performed in a conventional manner.

Referring to FIGS. 8 and 9, when it is desired to retrieve the core barrel assembly 10, fluid 11 injection in the bore hole is stopped. However, there is typically fluid 11 remaining in the outer tube 12 proximal to the core barrel assembly 10. Then, an overshot 100 secured to a wire line is attached to the attachment 94 in a conventional manner and a pull is exerted on the wire line. This action moves the valve body 66 to the valve body proximal position. In turn, the valve aperture proximal end 90 abuts against the sleeve-to-valve element coupling member 96, which moves the locking element 36 to a position adjacent or proximal to the locking element proximal position. The weight of the core barrel assembly 10 is typically large enough to counteract the force exerted by the locking biasing element 56. This action also simultaneously moves the sleeve 28 to the sleeve proximal position, which retracts the latch dogs 24 in the locking assembly body 30 to the dog retracted position. Since movements of the valve element 72 relative to the locking assembly body 30 are limited by its link to the locking element 36 and sleeve 28, the valve element 72 remains in the open configuration, which allows flow of the fluid 11 across the latching assembly 24 so that the whole weight of the fluid proximal to the core barrel assembly 10 does not have to be moved.

Although the present invention has been described hereinabove by way of preferred embodiments thereof, it can be modified, without departing from the spirit and nature of the subject invention as defined in the appended claims.

What is claimed is:

1. A core barrel assembly for retrieving a core sample, said core barrel assembly being insertable in an outer tube part of a drill string and defining an outer tube passageway extending substantially longitudinally therethrough, said outer tube defining a recess extending substantially radially outwardly into said outer tube from said outer tube passageway, said core barrel assembly being usable with a fluid, said core barrel assembly comprising:

a core retrieving element defining an inner tube for retrieving said core sample thereinto;

a locking assembly for locking said core retrieving assembly inside said outer tube by latching to said recess, said locking assembly being mechanically coupled to said core retrieving element, said locking assembly including a substantially elongated locking assembly body defining a locking assembly body proximal end and a substantially longitudinally opposed locking assembly body distal end;

at least two latch dogs each defining a dog proximal section and a dog distal section substantially opposed thereto, said latch dogs being pivotally mounted to said locking assembly body in said dog distal section so as to be movable between a dog retracted configuration and a dog extended configuration, said dog proximal sections being spread apart from each other to a greater extent in said dog extended configuration than in said dog retracted configuration, said latch dogs protruding laterally outwardly from said locking assembly body in said dog extended configuration;

a locking element provided laterally inwardly relative to said latch dogs, said locking element being movable substantially longitudinally along said locking assembly body between a locking element proximal position and a locking element distal position, said locking element being movable to said locking element distal position only when said latch dogs are in said dog extended configuration and said locking element allowing movement of said latch dogs to said dog retracted configuration only when said locking element is in said locking element proximal position; and a dog retracting element for selectively moving said latch dogs to said dog retracted configuration; and a valve assembly mechanically coupled to said locking assembly and provided proximally relative thereto, said valve assembly including a valve body defining a valve body proximal end and a substantially longitudinally opposed valve body distal end, said valve body also defining a fluid flow passageway extending longitudinally in said valve body, said valve body also defining an inlet and an outlet both in fluid communication with said fluid flow passageway, said inlet being provided proximally relative to said outlet, said valve body being movable substantially longitudinally relative to said locking assembly body between a valve body proximal position and a valve body distal position, said valve body and said locking assembly body being distanced from each other to a greater extent in said valve body proximal position than in said valve body distal position, said valve body including a seal provided outside of said fluid flow passageway between said inlet and said outlet for preventing flow of said fluid outside of said valve when said core barrel assembly is inserted in said outer tube, said valve assembly also including a valve element movable relative to said valve body between a closing position and an opening position, wherein, in said closing position, said valve element substantially obstructs said fluid flow passageway to prevent a substantial flow of said fluid therethrough, and, in said opening position, said valve element is at least partially retracted from said fluid flow passageway to allow a flow of said fluid therethrough;

said core barrel assembly being operable between a lowering configuration, a locked configuration and a retrieving configuration, wherein in said lowering configuration, said latch dogs are in said dog retracted configuration, said locking element is in said locking element proximal position, said valve body is in said valve body distal position and said valve element is in said closing position;

in said locked configuration, said latch dogs are in said dog extended configuration, said locking element is in said locking element distal position, said valve body is in said valve body distal position and said valve element is in said opening position; and in said retrieving configuration, said latch dogs are in said dog retracted configuration, said locking element is either in said locking element proximal position or in a position proximal relative to said locking element proximal position, said valve body is in said valve body proximal position and said valve element is in said opening position;

whereby in said lowering configuration, said core barrel assembly is movable along said outer tube while preventing flow of said fluid through said fluid flow passageway;

in said locked configuration, said core barrel assembly is latchable to said recess with said latch dogs and allows flow of said fluid through said fluid flow passageway, said latch dogs being locked in said dog extended configuration by said locking element; and in said retrieving configuration said core barrel assembly is movable along said outer tube while allowing flow of said fluid through said fluid flow passageway.

2. A core barrel assembly as defined in claim 1, wherein said valve element is provided substantially adjacent said outlet and is movable substantially longitudinally relative to said valve body between said closing and opening positions, said closing position being proximal relative to said opening position.

3. A core barrel assembly as defined in claim 2, wherein said locking element and said valve element are operatively coupled to each other so as to be jointly movable relative to said locking assembly body.

4. A core barrel assembly as defined in claim 3, wherein said dog retracting element includes a sleeve provided outside of said of said locking assembly body, said sleeve being movable substantially longitudinally along said locking assembly body between a sleeve proximal position and a sleeve distal position, wherein, in said sleeve proximal position, at least part of said sleeve is in register with said dog proximal sections so that said latch dogs are forced in said dog retracted configuration, and, in said sleeve distal position, said sleeve is retracted from said dog proximal sections to allow movement of said latch dogs to said dog extended configuration.

5. A core barrel assembly as defined in claim 4, wherein said sleeve is operatively coupled to said locking element and to said valve element so as to be jointly movable therewith relative to said locking assembly body so that when said locking element is in said locking element proximal and distal positions, said sleeve is respectively in said sleeve proximal and distal positions.

6. A core barrel assembly as defined in claim 5, wherein said valve body further includes an attachment for attaching a core barrel retrieving element thereto.

7. A core barrel assembly as defined in claim 5, further comprising a locking biasing element operatively coupled to said locking assembly body and to said locking element to bias said locking element towards said locking element distal position.

8. A core barrel assembly as defined in claim 5, wherein said valve body defines a valve body passageway distal relative to said fluid flow passageway, said valve element being mounted in said valve body passageway;

said valve body also defines a valve body aperture extending laterally outwardly from said valve body passageway;

said core barrel assembly includes a sleeve-to-valve element coupling member extending between said sleeve and said valve element, said sleeve-to-valve element coupling member extending through said valve body aperture and being movable longitudinally relative thereto.

9. A core barrel assembly as defined in claim 5, wherein said locking assembly body defines a locking assembly body passageway proximal to said dog distal sections, said locking element being mounted in said locking assembly body passageway;

said locking assembly body also defines a locking assembly body aperture extending laterally outwardly from said locking assembly body passageway;

said core barrel assembly includes a sleeve-to-locking element coupling member extending between said sleeve and said locking element, said sleeve-to-locking element coupling member extending through said locking assembly body aperture and being movable longitudinally relative thereto.

10. A core barrel assembly as defined in claim 1, wherein said latch dogs are biased towards said dog retracted configuration.

11. A core barrel assembly as defined in claim 1, wherein said latch dogs are both pivotable about a common dog pivot axis.

12. A core barrel assembly as defined in claim 1, wherein said latch dogs each define a notch for receiving part of said locking element thereinto.

13. A latching assembly, said latching assembly being insertable in an outer tube part of a drill string, said outer tube defining an outer tube passageway extending substantially longitudinally therethrough, said outer tube defining a recess extending substantially radially outwardly into said outer tube from said outer tube passageway, said latching assembly being usable with a fluid, said latching assembly comprising:

a locking assembly for locking said core retrieving assembly inside said outer tube by latching to said recess, said locking assembly being attachable to said core retrieving element, said locking assembly including a substantially elongated locking assembly body defining a locking assembly body proximal end and a substantially longitudinally opposed locking assembly body distal end;

at least two latch dogs each defining a dog proximal section and a dog distal section substantially opposed thereto, said latch dogs being pivotally mounted to said locking assembly body in said dog distal section so as to be movable between a dog retracted configuration and a dog extended configuration, said dog proximal sections being spread apart from each other to a greater extent in said dog extended configuration than in said dog retracted configuration, said latch dogs protruding laterally outwardly from said locking assembly body in said dog extended configuration;

a locking element provided laterally inwardly relative to said latch dogs, said locking element being movable substantially longitudinally along said locking assembly body between a locking element proximal position and a locking element distal position, said locking element being movable to said locking element distal position only when said latch dogs are in said dog extended configuration and said locking element allowing movement of said latch dogs to said dog retracted configuration only when said locking element is in said locking element proximal position; and a dog retracting element for selectively moving said latch dogs to said dog retracted configuration; and a valve assembly mechanically coupled to said locking assembly and provided proximally relative thereto, said valve assembly including a valve body defining a valve body proximal end and a substantially longitudinally opposed valve body distal end, said valve body also defining a fluid flow passageway extending longitudinally in said valve body, said valve body also defining an inlet and an outlet both in fluid communication with said fluid flow passageway, said inlet being provided proximally relative to said outlet, said valve body being movable substantially longitudinally relative to said locking assembly body between a valve body proximal position and a valve body distal position, said valve body and said locking assembly body being distanced from each other to a greater extent in said valve body proximal position than in said valve body distal position, said valve body including a seal provided outside of said fluid flow passageway between said inlet and said outlet for preventing flow of said fluid outside of said valve when said latching assembly is inserted in said outer tube, said valve assembly also including a valve element movable relative to said valve body between a closing position and an opening position, wherein, in said closing position, said valve element substantially obstructs said fluid flow passageway to prevent a substantial flow of said fluid therethrough, and, in said opening position, said valve element is at least partially retracted from said fluid flow passageway to allow a flow of said fluid therethrough;

said latching assembly being operable between a lowering configuration, a locked configuration and a retrieving configuration, wherein in said lowering configuration, said latch dogs are in said dog retracted configuration, said locking element is in said locking element proximal position, said valve body is in said valve body distal position and said valve element is in said closing position;

in said locked configuration, said latch dogs are in said dog extended configuration, said locking element is in said locking element distal position, said valve body is in said valve body distal position and said valve element is in said opening position; and in said retrieving configuration, said latch dogs are in said dog retracted configuration, said locking element is either in said locking element proximal position or in a position proximal relative to said locking element proximal position, said valve body is in said valve body proximal position and said valve element is in said opening position;

whereby in said lowering configuration, said latching assembly is movable along said outer tube while preventing flow of said fluid through said fluid flow passageway;

in said locked configuration, said latching assembly is latchable to said recess with said latch dogs and allows flow of said fluid through said fluid flow passageway, said latch dogs being locked in said dog extended configuration by said locking element; and in said retrieving configuration said latching assembly is movable along said outer tube while allowing flow of said fluid through said fluid flow passageway.

14. A latching assembly as defined in claim 13, wherein said valve element is provided substantially adjacent said outlet and is movable substantially longitudinally relative to said valve body between said closing and opening positions, said closing position being proximal relative to said opening position, said locking element and said valve element being operatively coupled to each other so as to be jointly movable relative to said locking assembly body.

15. A latching assembly as defined in claim 14, wherein said dog retracting element includes a sleeve provided outside of said of said locking assembly body, said sleeve being movable substantially longitudinally along said locking assembly body between a sleeve proximal position and a sleeve distal position, wherein, in said sleeve proximal position, at least part of said sleeve is in register with said dog proximal sections so that said latch dogs are forced in said dog retracted configuration, and, in said sleeve distal position, said sleeve is retracted from said dog proximal sections to allow movement of said latch dogs to said dog extended configuration.

16. A latching assembly as defined in claim 15, wherein said sleeve is operatively coupled to said locking element and to said valve element so as to be jointly movable therewith relative to said locking assembly body so that when said locking element is in said locking element proximal and distal positions, said sleeve is respectively in said sleeve proximal and distal positions.

17. A latching assembly as defined in claim 16, further comprising a locking biasing element operatively coupled to said locking assembly body and to said locking element to bias said locking element towards said locking element distal position.

18. A latching assembly as defined in claim 16, wherein said valve body defines a valve body passageway distal relative to said fluid flow passageway, said valve element being mounted in said valve body passageway;

said valve body also defines a valve body aperture extending laterally outwardly from said valve body passageway;

said core barrel assembly includes a sleeve-to-valve element coupling member extending between said sleeve and said valve element, said sleeve-to-valve element coupling member extending through said valve body aperture and being movable longitudinally relative thereto.

19. A latching assembly as defined in claim 16, wherein said locking assembly body defines a locking assembly body passageway proximal to said dog distal sections, said locking element being mounted in said locking assembly body passageway;

said locking assembly body also defines a locking assembly body aperture extending laterally outwardly from said locking assembly body passageway;

said core barrel assembly includes a sleeve-to-locking element coupling member extending between said sleeve and said locking element, said sleeve-to-locking element coupling member extending through said locking assembly body aperture and being movable longitudinally relative thereto.

20. A latching assembly as defined in claim 13, wherein said latch dogs are biased towards said dog retracted configuration.

* * * * *